US007036396B2

(12) United States Patent
Moe et al.

(10) Patent No.: US 7,036,396 B2
(45) Date of Patent: May 2, 2006

(54) DRILL PIPE SPINNER DEVICE

(75) Inventors: Magne Moe, Harstad (NO); Per Olav Haughom, Tonstad (NO); Jørn Pollestad, Bryne (NO)

(73) Assignee: National Oilwell Norway AS, Stavanger (NO)

( * ) Notice: Subject to any disclaimer, the term of this patent is extended or adjusted under 35 U.S.C. 154(b) by 0 days.

(21) Appl. No.: 10/258,678

(22) PCT Filed: Apr. 25, 2001

(86) PCT No.: PCT/NO01/00171

§ 371 (c)(1),
(2), (4) Date: Apr. 11, 2003

(87) PCT Pub. No.: WO01/83935

PCT Pub. Date: Nov. 8, 2001

(65) Prior Publication Data

US 2003/0164071 A1 Sep. 4, 2003

(30) Foreign Application Priority Data

Apr. 28, 2000 (NO) ..... 002258

(51) Int. Cl.
*B25B 17/00* (2006.01)

(52) U.S. Cl. ..... 81/57.2; 81/57.19; 81/57.16; 81/57.34; 81/57.25; 294/88

(58) Field of Classification Search ..... 81/57.2, 81/57.19, 57.16, 57.34, 57.25; 294/88, 106; 173/164; 269/238, 22, 242
See application file for complete search history.

(56) References Cited

U.S. PATENT DOCUMENTS 3,892,148 A 7/1975 Wiley (Continued)

FOREIGN PATENT DOCUMENTS

| | | |
|---|---|---|
| GB | 1 416 245 | 12/1975 |
| GB | 1 469 661 | 4/1977 |
| GB | 1 499 428 | 2/1978 |
| GB | 1 519 086 | 7/1978 |
| NO | 143 235 | 1/1981 |
| NO | 306 573 | 11/1999 |
| SU | 1 640 353 | 4/1991 |
| WO | 00/66875 | 11/2000 |

*Primary Examiner*—Joseph J. Hail, III
*Assistant Examiner*—Alvin J Grant
(74) *Attorney, Agent, or Firm*—Andrus, Scales, Starke & Sawall, LLP

(57) ABSTRACT

In spinner tongs, a so-called spinner (30), incorporated in an iron roughneck and thus serving to rotate a drill pipe during connection thereof to a drill string or during division of the drill string into individual pipes, the aim has been to reduce damage on the threaded connections (the pin-and-box joints) in the screwing/unscrewing operations. This is realised in an operation for the simultaneous centering and rotating of the drill pipe. Four spinner rollers (42) known in themselves, which are brought to bear on the drill pipe when surrounding it, are mounted according to the invention, preferably in pairs, at the outer ends of driven clamping arms (46), by bogies (50). At their opposite outer ends the clamping arms (46) are pivotally supported on a fixed frame part/structure (56) and are jointed to each other by means of a piston and cylinder (48) driven by pressure fluid and arranged to carry the clamping arms (46) towards and away from each other. For their forced centering the clamping arms (46) have a centering stay (58) arranged thereto, which is connected by its outer end to one clamping arm (46), and is connected by its other outer end to the other clamping arm (46). For the parallel displacement of the rollers (42), each bogie (50) has a parallel stay (54) arranged thereto, whose other end is supported on a fixed frame part/structure (56).

19 Claims, 8 Drawing Sheets

U.S. PATENT DOCUMENTS 4,023,449 A * 5/1977 Boyadjieff ..... 81/57.16
4,082,017 A * 4/1978 Eckel ..... 81/57.16
4,348,920 A * 9/1982 Boyadjieff ..... 81/57.25
4,366,606 A * 1/1983 Willis et al. ..... 269/218
4,446,761 A * 5/1984 Boyadjieff et al. ..... 81/57.19
4,449,596 A * 5/1984 Boyadjieff ..... 175/85
4,709,766 A * 12/1987 Boyadjieff ..... 175/52
4,765,401 A * 8/1988 Boyadjieff ..... 166/77.53
4,774,861 A 10/1988 Hamilton et al.
5,054,550 A * 10/1991 Hodge ..... 166/78.1

* cited by examiner

DRILL PIPE SPINNER DEVICE

CROSS REFERENCE TO RELATED APPLICATION

The present application is the U.S. national stage application of International Application PCT/NO01/00171, filed Apr. 25, 2001, which international application was published on Nov. 8, 2001 as International Publication WO 01/83935. The International Application claims priority of Norwegian Patent Application 20002258, filed Apr. 28, 2000.

SUMMARY OF THE INVENTION

This invention relates to a spinner/spinner tong device for use in the screwing or unscrewing of threaded connections in the form of internally threaded box ends, each to be brought into engagement with/disengaged from an externally threaded pin end of an adjacent pipe length or pipe section, especially lengths of drill pipe of the kind being screwed together for the formation of a continuous drill string for use in connection with the drilling for oil and gas deposits.

In the following a spinner indicates a spinner or spinner tongs, unless otherwise explicitly specified.

When a drill string is to be pulled out of the well bore or assembled immediately above it, for example, in connection with replacement of drill bit, the entire drill string length used must be hoisted or lowered by means of draw works in the derrick of the rig.

Screwing of the threaded connections (boxes and pipe end pins) ensures the connection of lengths of drill pipe or division of the drill string, according to what is required in the individual case. Screwing is effected by means of an iron roughneck, which comprises partly a fast-rotating screwing device/unscrewing device of a small torque, in the form of a spinner, and a device which may effect tightening/unscrewing at a desired maximum torque on the pipe box, in the form of a so-called torque wrench.

In principle, a spinner is formed with four rollers, each driven by a separate hydraulic motor. The rollers are forced against the drill pipe wall by means of hydraulic piston and cylinders.

There are several known embodiments, in which devices are arranged to force rollers against the drill pipe.

From Norwegian patent document No. 306 573 is known a torque wrench for the torqued tightening of drill pipes with boxes, in which the upper and lower clamping jaws are operated by hydraulic cylinders, and there is a spinner arranged to a main structure. A torque wrench is mounted by a quick-release coupling to a telescopic manipulator arm, which can be pivoted about a vertical axis by means of a slewing ring, which is fixedly connected to a drill floor of a sea-based installation.

In connection with the torque wrench according to NO 306 573, the aim has been to arrange the torque wrench so, that it has been assigned and covers a wide working area. Clamping jaws are arranged, which are rotated by means of a gear rim connected to a gear. The latter is brought into rotation by a planetary gear, thereby securing, through the rotation of the clamping jaws, the rotary motion necessary for the screwing (unscrewing). A spinner is here equipped with a mechanical synchronizing gear drive between the drive rollers.

Of other known devices for the screwing of pipe joining devices on drill pipe ends, may be mentioned for example GB 1 416 245, GB 1 469 661, GB 1 519 086 and NO 143 235.

An unfavorable common feature of known embodiments is, however, that they are not formed to allow centering of the drill pipe, which is to be lowered into the opposite box as two drill pipes are being screwed together.

When the drill pipes are to be unscrewed from one another, it is important that the weight of the drill pipe is released when the last thread leaves the box, so that there will be no impact against the threaded connection.

BRIEF DESCRIPTION OF THE INVENTION

This approach to the problems forms the basis of the present invention, whose general object it has been, by simple and reasonable means, to provide a spinner which both rotates and centers the length of drill pipe concerned, which is to be screwed together with the opposite threaded box. The spinner should also be arranged to relieve the threads with respect to weight load when the last thread leaves the box in the parting of pin-and-box joints.

For the purpose mentioned the invention is characterized by the features specified in the claims. Advantageous, but subordinate features, which are not critical to the intended function and technical effect of the invention, appear in the claims.

A spinner of this kind comprises a frame part/structure with steering/guide rollers mounted on two vertical guides and comprising preferably four driven rotary rollers for the rotation of a drill pipe, said rotary rollers being manufactured from steel or a similar hard metal or metal alloy, and being driven by means of preferably hydraulic motors. According to the invention the driven rotary rollers are supported on bogies mounted on clamping arms, which are maneuvered by means of a maneuvered device in the form of a transverse hydraulic piston and cylinder or other actuator, parallel displacement stays and centering stays being arranged for said clamping arms.

For the spinner tongs a further piston and cylinder may be arranged, which exhibits sufficient lifting power to raise the spinner and drill pipe. Thereby the spinner and pipe section can be lifted free of the threaded potion when the pipes are being unscrewed from one another.

Said parallel displacement stays and centring stays may be provided with a spring-based centring unit, for example comprising two individual springs.

The device according to the invention is also formed with a view to reducing damage on the threaded connections as drill pipe sections are being screwed and unscrewed. Damage of the kind reduced or even eliminated through the present invention, has at all times represented an increased risk of drill string breakdown, with great economic consequences.

BRIEF DESCRIPTION OF THE DRAWING

Non-limiting examples of preferred embodiments of devices formed and arranged in accordance with the present invention are explained in further detail in the following, with reference to the accompanying drawings, in which.

DETAILED DESCRIPTION OF THE INVENTION

Figure 1:
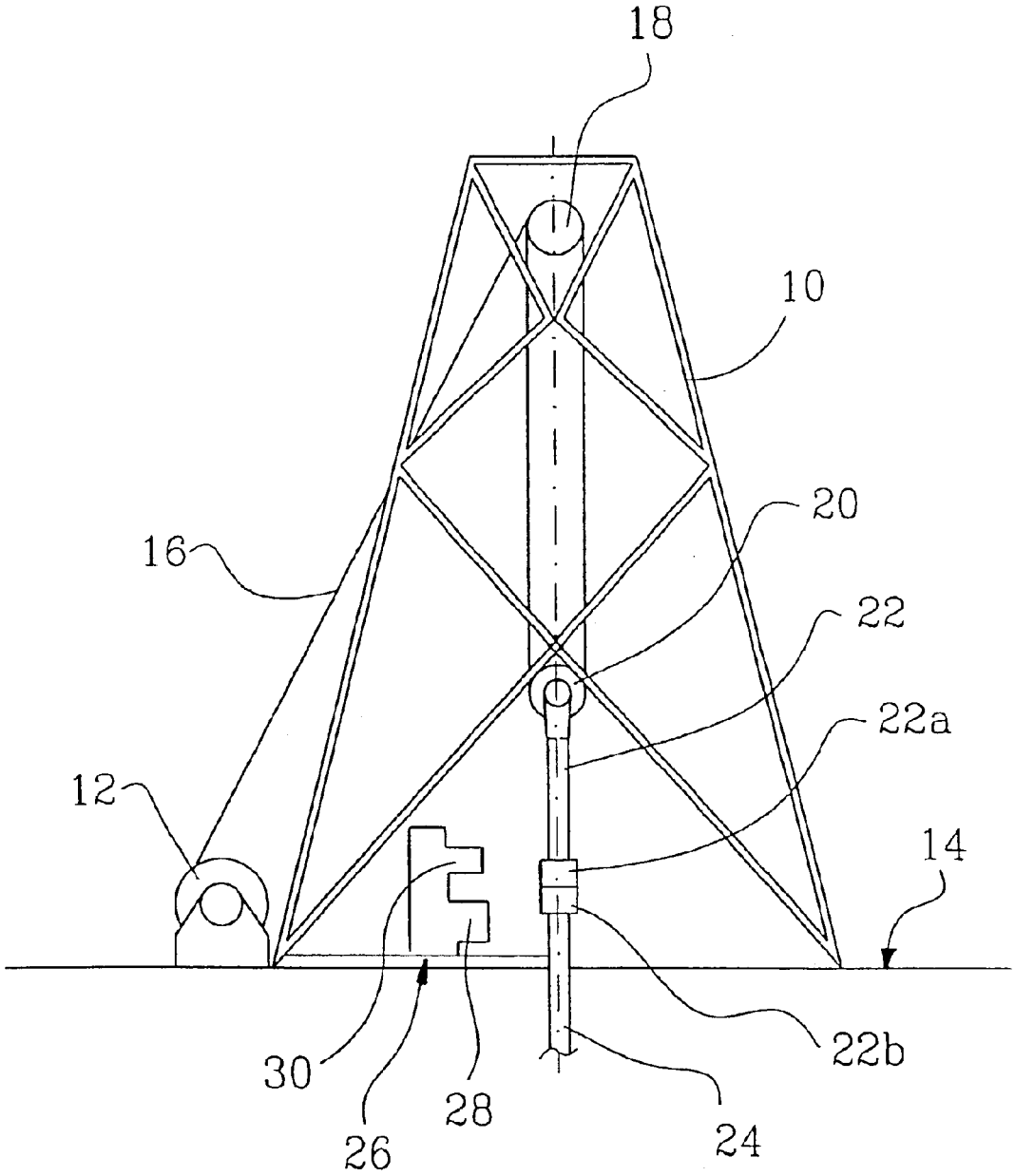
FIG. 1 shows in a side view a principle drawing illustrating a highly simplified derrick with draw works, an iron roughneck and a suspension device for suspending lengths of drill pipe which are to be screwed together and made up by the threaded connections by means of the iron roughneck for the formation of a continuous drill string.

Reference is made to FIG. 1, in which the reference numeral 10 identifies a derrick with draw works 12 arranged thereto on the drill floor 14 of a platform, not shown in further detail, a wire line 16 leading from the draw works 12 up to a tackle 18 suspended from the derrick 10, and carrying through the wire line 16 an underlying tackle 20, from which the drill pipe length/section 22 is suspended.

A number of such lengths/sections 22 of drill pipe are to be joined together through pin-and-box connections consisting of an upper part 22*a* and a lower part 22*b* in the form of a threaded male part, "a pin", and a threaded female part, "a box", for the formation of a continuous drill string 24.

For screwing together the drill pipe lengths/sections 22 and tightening the threaded connections at the ends thereof, an iron roughneck is used, generally identified by the reference numeral 26, in principle comprising two main components, a lower component in the form of a torque wrench 28, and an upper component in the form of a spinner 30. The drill string 24 is lifted and lowered into the borehole (not shown) by means of the draw works 12, whose wire line 16 runs over the tackles 18, 20 suspended from the derrick 10. This represents well-known technique.

Figure 2:
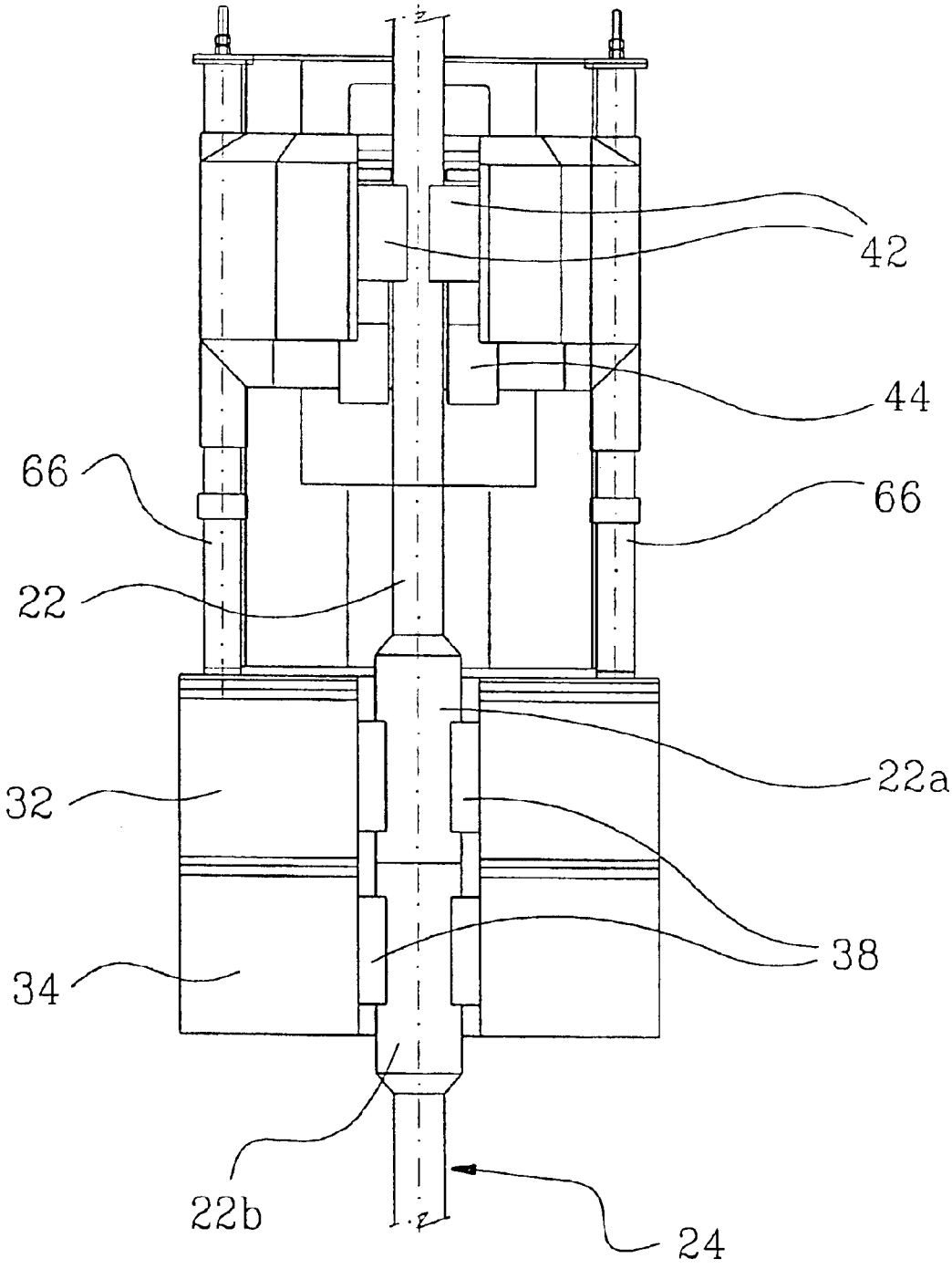
FIG. 2 shows a front view of the iron roughneck.
Figure 3:
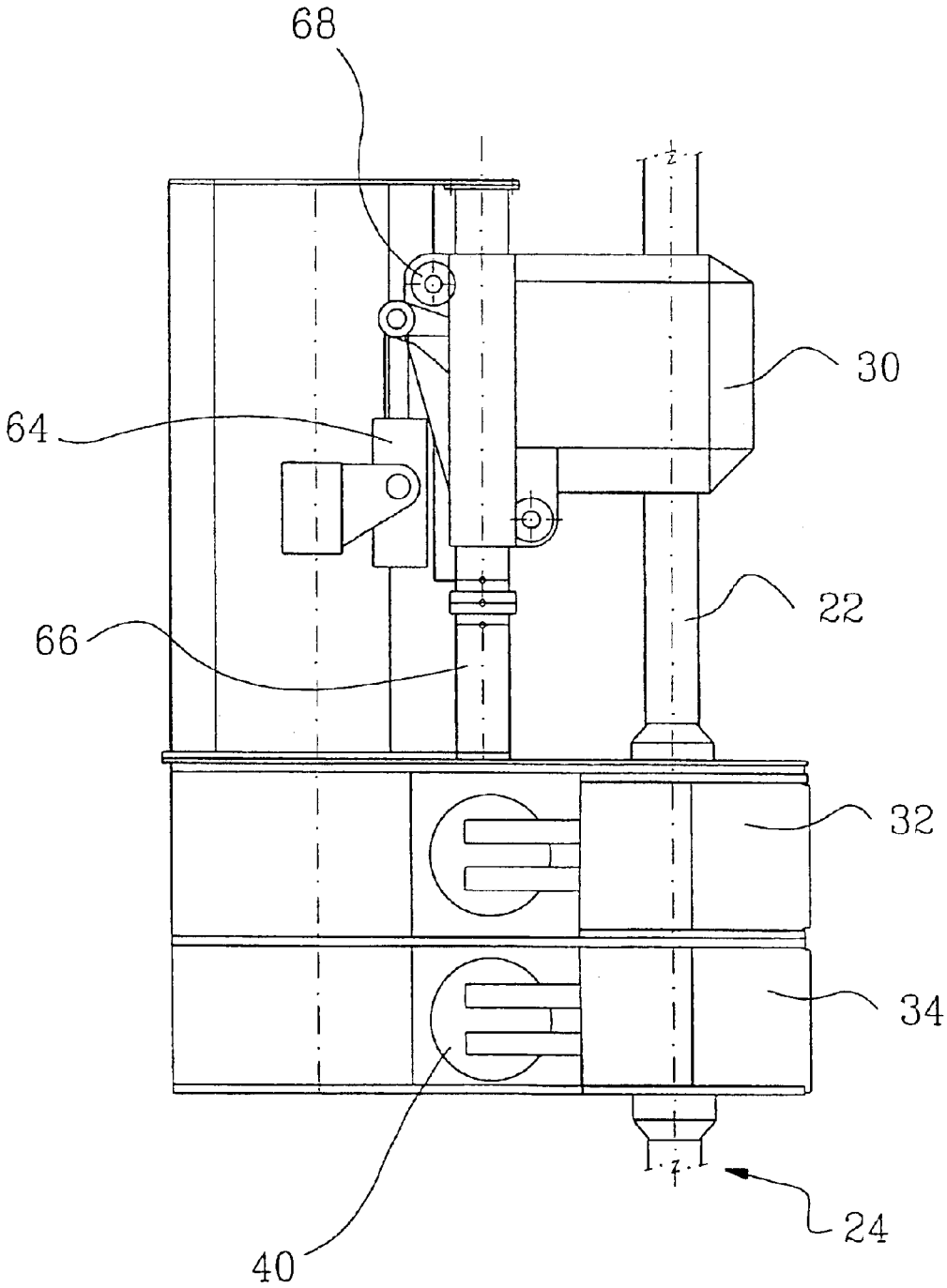
FIG. 3 shows the iron roughneck shown in FIG. 2 in a side view.

The torque wrench 28 itself comprises two parts, namely an upper part 32 and a lower part 34, FIGS. 2 and 3. The lower part 34 of the torque wrench 28 is fixedly connected to a frame part or structure 36, whereas the upper torque wrench part 32 can be pivoted through a given angle relative to the lower torque wrench part 34, the torque wrench 28 being provided with clamping jaws 38, which are brought to grip and clamp a drill pipe 22 by means of hydraulic piston and cylinders 40.

When drill pipe lengths/sections 22 are to be screwed together for the formation of a continuous drill string 24, the lower part 34 of the torque wrench 28 will first be is brought to grip about the lower portion of the box connection part 22*b*. Then the pipe section/length 22 is placed in the spinner 30 by means of a not shown pipe handling device of a known embodiment.

According to the invention the spinner 30 is formed and arranged to center the respective pipe 22, and on reception of the pipe it provides for it to be centered while it is being lowered at the same time with its connecting part, the externally threaded pin/spigot end 22*a*, into the underlying box part 22*b* of the joint/threaded connection.

Figure 4:
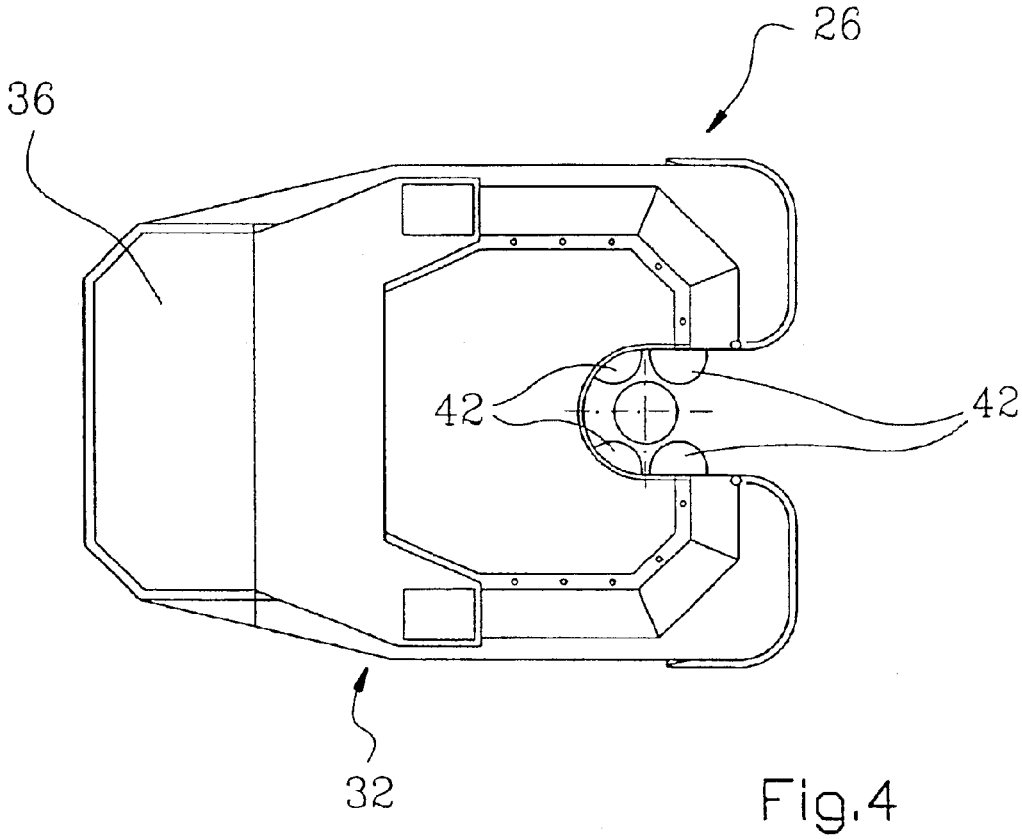
FIG. 4 shows the iron roughneck in a top plan view.
Figure 6:
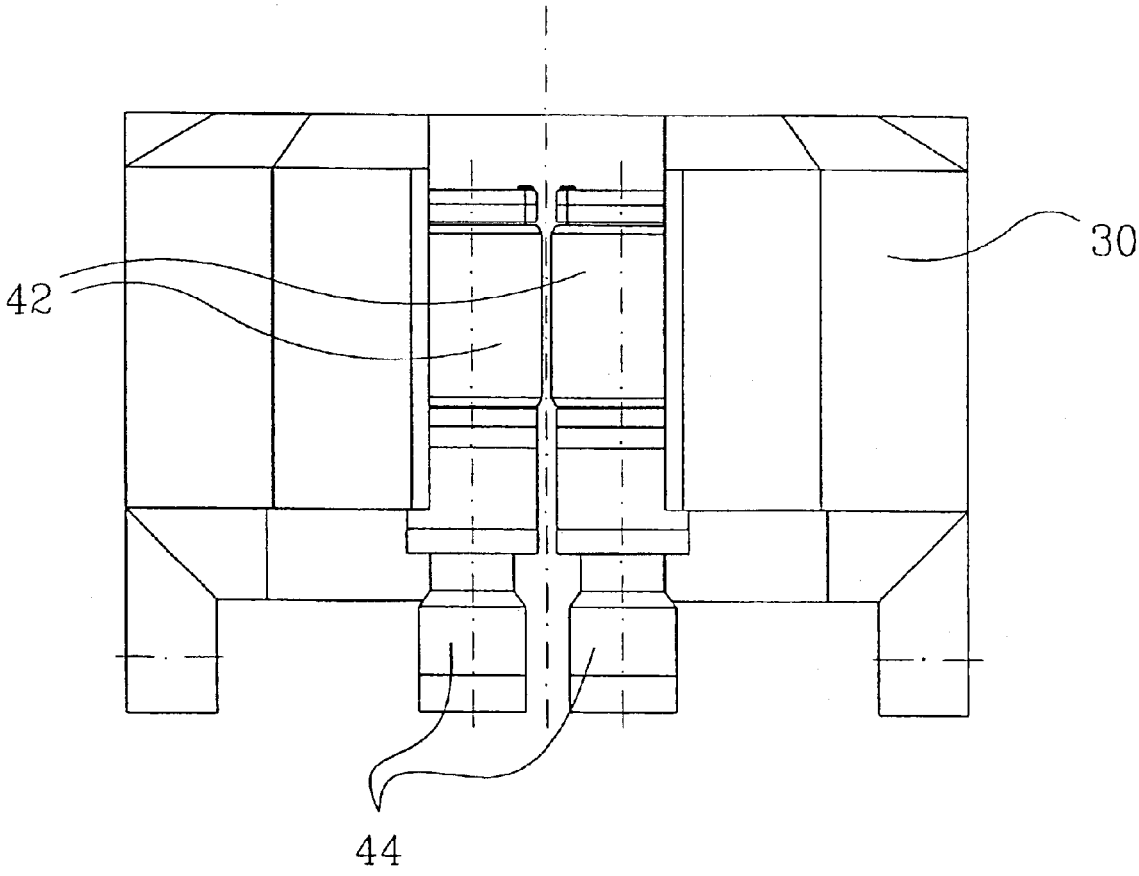
FIG. 6 shows the spinner itself in elevation.

The driven rollers 42 of the spinner 30, which are to rotate the pipe 22, the so-called spinner rollers, are arranged in a number of four, arranged in pairs, two on either side of the pipe 22, referring to the transverse direction of the iron roughneck, FIGS. 4 and 6, are driven by a hydraulic torque motor 44 each, and effect a rotation of the pipe 22 until the upper and lower parts 22*a*, 22*b* of the pin-and-box are fully joined.

Then the upper part 32 of the torque wrench part 28 is brought to clamp during rotation, until the desired tightening torque is achieved.

Figure 7A:
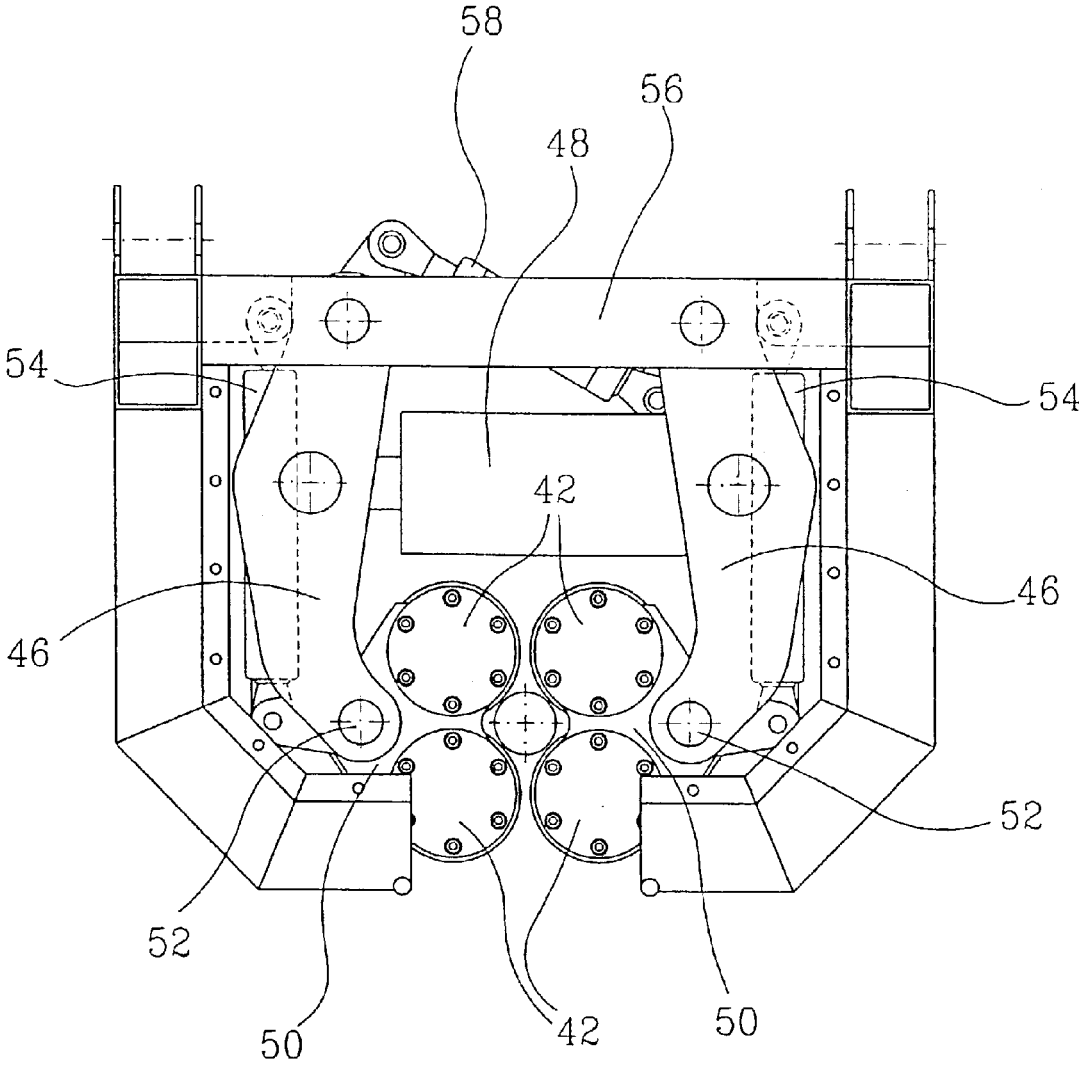
FIG. 7A is a top plan view of the spinner shown in a more detailed configuration, and with the drive rollers pivoted inwards towards one another, so that they adopt inner active positions for the rotation of a drill pipe not shown.
Figure 7B:
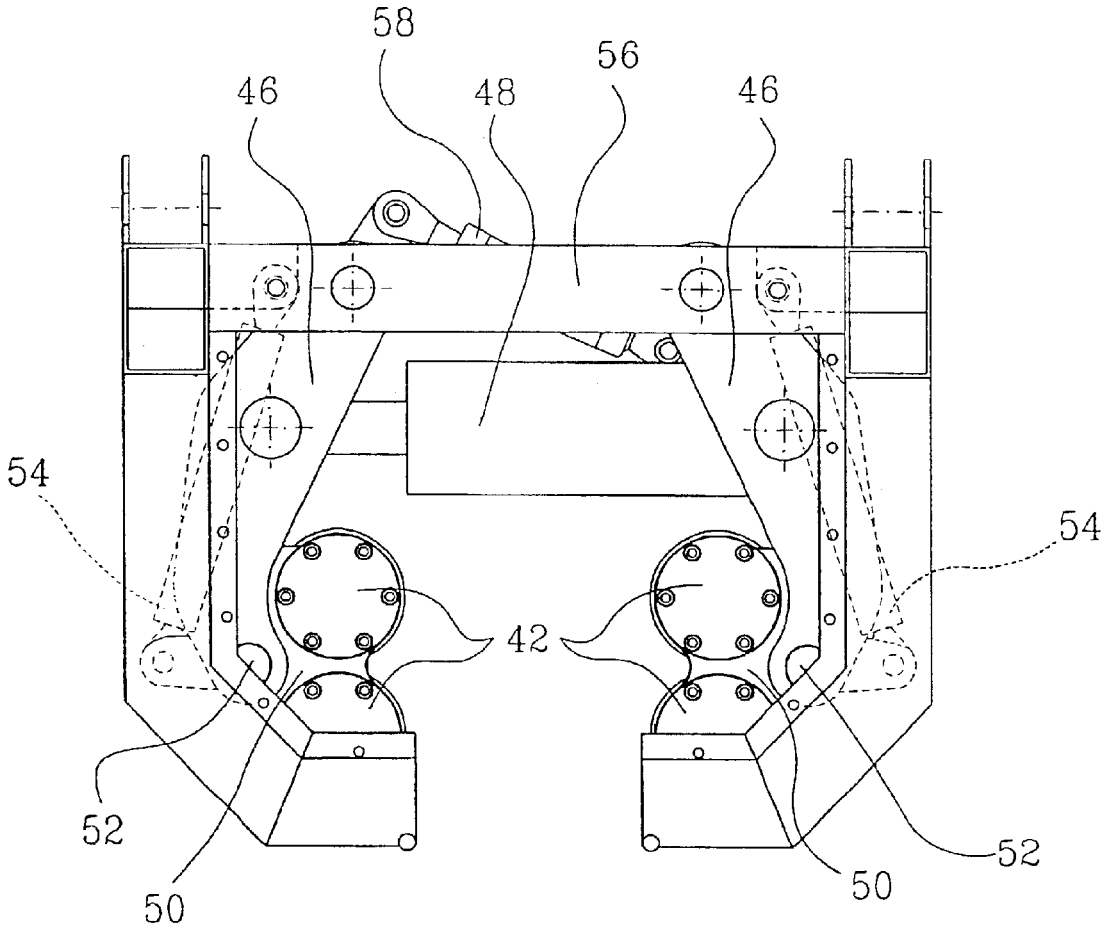
FIG. 7B corresponds to FIG. 7A, except that here the drive rollers have been carried away from each other and are spaced apart in the transverse direction, thereby adopting their idle stand-by positions.

The above-mentioned centring of the pipe 22 within the spinner 30 is effected by means of two clamping arms 46, FIGS. 7A and 7B, which have a piston and cylinder 48 arranged thereto, whereby the clamping arms 46 can be forced together and carried away from each other, each forming a support for a bogie 50 carrying respective two spinner rollers 42. Each bogie 50 is mounted to the outer end of the adjacent clamping arm 46 by a bolt connection 52.

Figure 8:
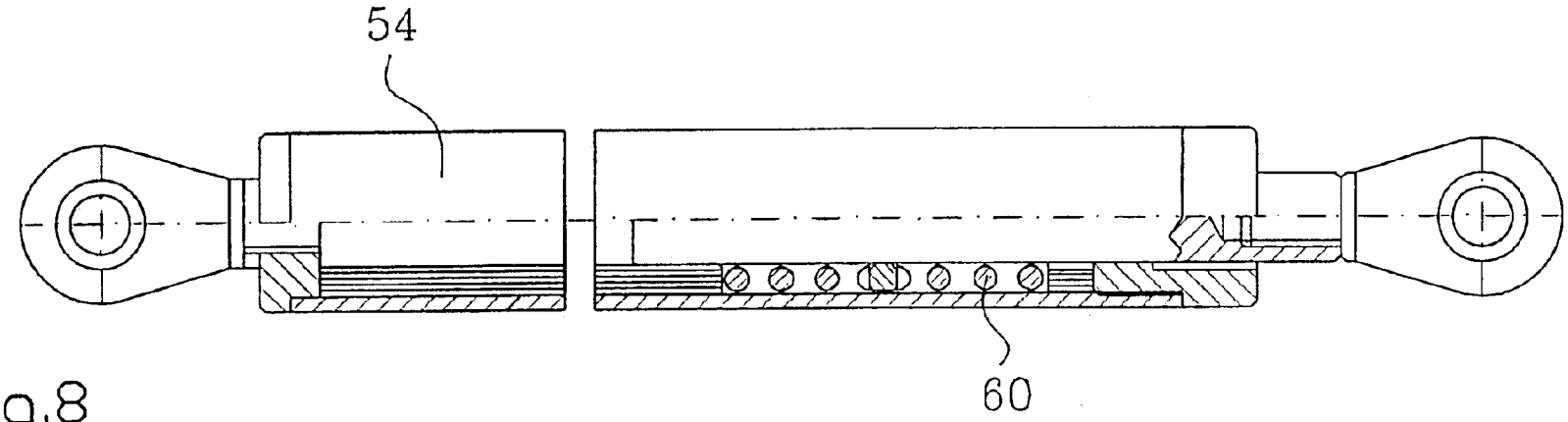
FIG. 8 shows separately a parallel stay for the parallel displacement of the drive/rotary rollers.
Figure 9:
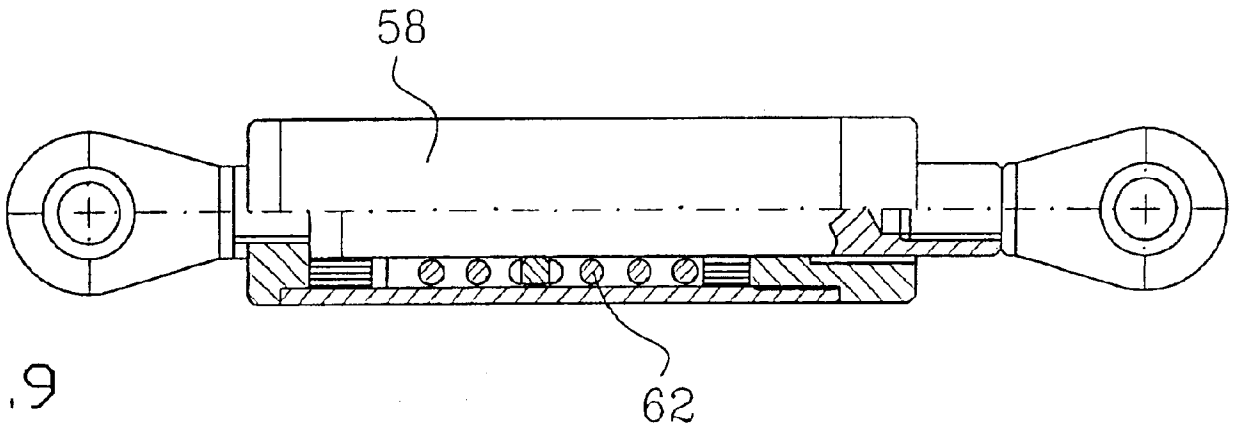
FIG. 9 shows separately a synchronizing stay, for not shown clamping arms carrying the driven, pivotable drive/rotary rollers by bogies.

The parallel displacement of the spinner rollers 42 is implemented by means of parallel stays 54, FIGS. 7A, 7B and 8, secured to a frame part or structure 56 and to respective bogies 50. The centering is provided by a centering stay (synchronizing stay) 58, FIGS. 7A, 7B and 9, jointed by its axial ends to the clamping arms 46, so that the latter are forcibly centered when the piston and cylinder 48 is being shortened and is pulling the clamping arms 46 together. Such a course of action is represented by FIG. 7A, based on FIG. 7B, in which the clamping arm maneuvering cylinder 48 is shown in an extended state, with clamping arms 46 and spinner rollers 46 in idle positions, at a maximum, or approximately maximum, distance from each other.

Both the parallel stay 54 and centering stay 58 are provided with an internal shock absorbing spring 60 and 62, respectively, see FIGS. 7A, 7B, 8 and 9, respectively.

A pneumatic piston and cylinder 64, FIG. 3, provides for return of the spinner 30 into its initial position when the threaded connection of the pipe joint is made up completely, and the spinner rollers 42 release the grip on the pipe 22. The entire spinner unit 30 is moved vertically along guide rails 66 by means of guide rollers 68, FIG. 3.

When the drill string is to be divided by unscrewing of the threaded connections/pin-and-box connections, the torque wrench 28 first provides the loosening of the pin-and-box joints, so that the spinner 30 may then take over and unscrew the threads that are in engagement. This is implemented in that the spinner 30 is brought to grip about the drill pipe with its rollers 42 bearing on the outer surface thereof, while at the same time the pneumatic piston-and-cylinder 64, FIG. 3, is sized and activated for a power sufficient to lift both the spinner 30 and the drill pipe 22 up freely as the threaded end portion 22*a* runs out of the underlying box joint 22*b*.

Figure 5:
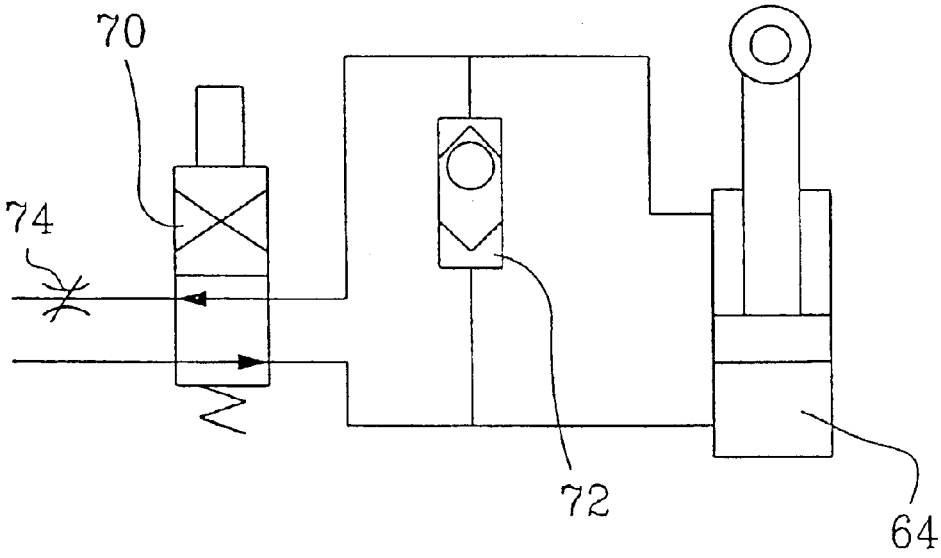
FIG. 5 shows a circuit diagram of a pressure air circuit for the lifting cylinder of the spinner.

The pressure air cylinder 64 is activated by means of a valve 70 and a change valve 72. In one valve position the cylinder chambers on both sides of the piston are pressurized. In this position the lifting power of the pressure air cylinder 64 is only sufficient to lift the spinner 30 back into its upper position, FIG. 5. In another valve position the cylinder chamber is pressurized one-sidedly on the piston side, so that the lifting power will be sufficiently great to lift both the spinner 30 and the drill pipe section 22 free of the box connection 22*b* by the unscrewing. From FIG. 5 it further appears that a choking nozzle 74 is arranged to limit the piston speed to a desired level.

What is claimed is:

1. A spinner apparatus for connecting and disconnecting drill pipes in a continuous drill string, the spinner apparatus comprising:

elongated clamping arms movable towards and away from each other by an actuator to releasably engage a drill pipe in the drill string;

at least one pair of spinner rollers rotatably coupled to the clamping arms, the spinner rollers imparting rotary motion on the drill pipe;

at least one parallel stay coupled to each clamping arm and arranged substantially parallel to the respective clamping arm for controlling parallel displacement of the spinner rollers; and a centering stay arranged substantially transverse to the parallel stays and interconnecting the clamping arms to forcibly center the clamping arms during connecting and disconnecting of the drill pipes.

2. The spinner apparatus according to claim 1 further comprising an iron roughneck housing the spinner apparatus.

3. The spinner apparatus according to claim 1, wherein the actuator is a piston and cylinder driven by pressurized fluid.

4. The spinner apparatus according to claim 1, wherein the actuator acts upon an intermediate portion of each respective clamping arm, the intermediate portion located between a supporting end and a grasping end of the respective clamping arm.

5. The spinner apparatus according to claim 1, wherein both said parallel and centering stays comprise a built-in centering spring device, the centering spring device comprising two springs.

6. The spinner apparatus according to claim 1, further comprising at least one bogie interconnecting the spinner rollers and each clamping arm.

7. The spinner apparatus according to claim 6, wherein the at least one parallel stay is mounted to the at least one bogie.

8. The spinner apparatus according to claim 6, wherein each clamping arm has a supporting end that is pivotally mounted to a fixed frame part and a grasping end that carries the respective at least one bogie and at least one pair of spinner rollers.

9. The spinner apparatus according to claim 8, wherein each clamping arm has substantially the same circumferential shape in a horizontal plane extending from the supporting end to the grasping end.

10. The spinner apparatus according to claim 8, wherein the at least one parallel stay is pivotally mounted to the fixed frame part and to the respective clamping arm.

11. The spinner apparatus according to claim 8, wherein the centering stay has a first end coupled to a first clamping arm at a location opposite the fixed frame part relative to an intermediate portion of the first clamping arm, and a second end coupled to a second clamping arm between the supporting end and an intermediate portion of the second clamping arm.

12. The spinner apparatus according to claim 11, wherein the first end of the centering stay comprises a support lug which forms an extension of the first clamping arm.

13. The spinner apparatus according to claim 11, wherein the second end of the centering stay comprises a support lug projecting away from the second clamping arm.

14. The spinner apparatus according to claim 1, wherein the spinner apparatus is arranged to be moved vertically along guides or guide rails.

15. The spinner apparatus according to claim 14, further comprising a lifting device which exhibits lifting power for lifting the spinner apparatus and drill pipe at the same time.

16. The spinner apparatus according to claim 15, wherein the lifting device comprises a pneumatic piston and cylinder.

17. The spinner apparatus according to claim 16, wherein the pneumatic piston and cylinder further comprise an activating valve and a change valve, wherein in a first valve condition, cylinder chambers on both sides of the piston are pressurized, and in a second valve condition, a cylinder chamber on only one side of the piston is pressurized, the first condition providing a lifting power that is only sufficient to lift the spinner apparatus alone into an upper position, and the second condition providing a lifting power that is sufficient to lift both the spinner apparatus and the drill pipes.

18. The spinner apparatus according to claim 16, wherein the lifting device further comprises a choking nozzle arranged to limit the speed of the piston in the cylinder to a desired level.

19. A spinner apparatus for connecting and disconnecting drill pipes in a continuous drill string, the spinner apparatus comprising:

elongated clamping arms movable towards and away from each other by an actuator to releasably engage a drill pipe in the drill string;

at least one pair of spinner rollers rotatably coupled to the clamping arms, the spinner rollers imparting rotary motion on the drill pipe;

at least one elongated resilient parallel stay, the elongated resilient parallel stay having one end pivotally mounted to a fixed frame part of the spinner apparatus and a second end pivotally mounted to one of the respective clamping arms; and a resilient centering stay interconnecting the clamping arms to forcibly center the clamping arms during connecting and disconnecting of the drill pipes.

* * * * *